US008232234B2

(12) United States Patent
Raj et al.

(10) Patent No.: US 8,232,234 B2
(45) Date of Patent: Jul. 31, 2012

(54) POLYMER-DERIVED LUBRICANT ADDITIVE FOR ULTRA-LOW WEAR APPLICATIONS

(75) Inventors: Rishi Raj, Boulder, CO (US); Sandeep R. Shah, Colorado Springs, CO (US)

(73) Assignee: PDC-Scientific, LLC, Boulder, CO (US)

( * ) Notice: Subject to any disclaimer, the term of this patent is extended or adjusted under 35 U.S.C. 154(b) by 12 days.

(21) Appl. No.: 12/784,420

(22) Filed: May 20, 2010

(65) Prior Publication Data

US 2010/0294230 A1 Nov. 25, 2010

Related U.S. Application Data

(60) Provisional application No. 61/180,011, filed on May 20, 2009.

(51) Int. Cl.
*C07F 7/08* (2006.01)
*C10M 169/04* (2006.01)
*F01M 5/02* (2006.01)

(52) U.S. Cl. ..... 508/207; 123/196 AB; 508/202

(58) Field of Classification Search ..... 508/207; 123/196 AB
See application file for complete search history.

(56) References Cited

U.S. PATENT DOCUMENTS

| | | | | |
|---|---|---|---|---|
| 3,344,066 | A * | 9/1967 | Delphenich et al. | 508/136 |
| 5,055,431 | A * | 10/1991 | Blum et al. | 501/96.2 |
| 6,586,376 | B1 * | 7/2003 | Nakanishi et al. | 508/437 |
| 2005/0247904 | A1 * | 11/2005 | Raj et al. | 252/62.9 R |
| 2008/0296527 | A1 * | 12/2008 | Liu et al. | 252/60 |

OTHER PUBLICATIONS

Prasad, S.V. et al., Mechanical and Tribological Behavior of Polymer-Derived Ceramics Constituted from $SiC_xO_yN_z$; J. Am. Ceram. Soc., 89 [12] 3706-3714 (2006).

* cited by examiner

*Primary Examiner* — Walter D Griffin
*Assistant Examiner* — Vishal Vasisth
(74) *Attorney, Agent, or Firm* — Lathrop & Gage LLP

(57) ABSTRACT

Polymer-derived nanocomposite lubricants reduce friction and wear in applications involving elevated temperatures, such as within an internal combustion engine.

14 Claims, 4 Drawing Sheets

POLYMER-DERIVED LUBRICANT ADDITIVE FOR ULTRA-LOW WEAR APPLICATIONS

RELATED APPLICATIONS

This application claims priority to U.S. provisional application Ser. No. 61/180,011 filed 20 May 2009, which is hereby incorporated by reference.

BACKGROUND

Description of the Related Art

Engine oil lubricates engines by providing a separating film between surfaces of adjacent moving parts. For example, engine oil may reduce friction between a piston and a cylinder. The oil may also lubricate such engine components as valve stems and cam shafts. Lubricating these engine part surfaces advantageously reduces overall engine wear; however, engine oil may thermally degrade over time due to high engine operating temperatures. Thermal degradation of engine oil produces changes in rheological properties, such as viscosity, that reduce the lifetime of the engine oil. Attempts to circumvent thermal degradation of engine oil include removing impurities via refinement processes and additives generally affecting the rheological or chemical properties of oil. For example, engine oil refinement processes aim to eliminate oxidative compounds that enhance thermal degradation of the oil, or which enhance non-Newtonian viscosity characteristics.

SUMMARY

The presently disclosed instrumentalities provide a new class of engine oil additives in the field of silicon-based polymer additives. Under heating conditions encountered in automotive engines, these materials are sometimes capable of producing protective nanocomposites resulting from thermal degradation of the additives. In other instances, the additives may be pre-treated by use of an ex-situ process for the betterment of improve engine wear characteristics.

In an embodiment, a method for improving engine wear comprises providing a mixture of silicon-based polymer and motor oil, adding the mixture to an oil reservoir of an engine and allowing the mixture to coat engine surfaces, pyrolyzing the silicon-based polymer material at the engine surfaces at temperatures of at least 600° C. to generate polymer-derived nanocomposite material, and adhering the polymer-derived nanocomposite material to engine surfaces to reduce friction of engine surfaces.

In an embodiment, an admixed engine oil contains a mixture of silicon-based polymer and motor oil, wherein the silicon-based polymer is a material selected from the group consisting of organopolysilazane, polysilazane, polycarbosilane, polysilane, polysiloxane, and combinations thereof.

In an embodiment, the silicon-based polymer additive, in liquid form, is added to the engine oil. The liquid silicon-based polymer cures into a crosslinked resin or plastic at the hot surfaces of the engine, such as where a piston and a cylinder surface rub against each other to generate elevated temperatures. The crosslinked resin is further converted into a wear-resistant coating of a ceramic formed by in-situ pyrolysis of the crosslinked resin, providing the improved performance of the engine, relative to state-of-the-art engine oils.

In an embodiment, the silicon-based polymer is first crosslinked ex-situ into a crosslinked resin powder, and then added to the engine oil in the form of a powder. The crosslinked resin, in the form of a powder, decomposes by pyrolytic action including at least partial pyrolysis into a ceramic which coats the hot surfaces of the engine, such as the piston and the cylinder, providing enhanced engine performance by reducing friction and engine-wear. In an embodiment, the particle size of the crosslinked resin powder is between 1 μm and 50 μm. In a preferred embodiment, the particle size of the crosslinked resin powder is between 30 μm and 40 μm.

In an embodiment, engine surfaces that bear friction and wear, such as the surfaces of pistons, cylinders, and other engine parts, are coated ex-situ with a thin film of liquid silicon-based polymer that is subsequently crosslinked to faun a crosslinked resin. The cross-linked resin film pyrolyzes in-situ into a wear-resistant ceramic coating during engine operation when friction by engine surfaces generate high temperatures.

DETAILED DESCRIPTION

Figure 1:
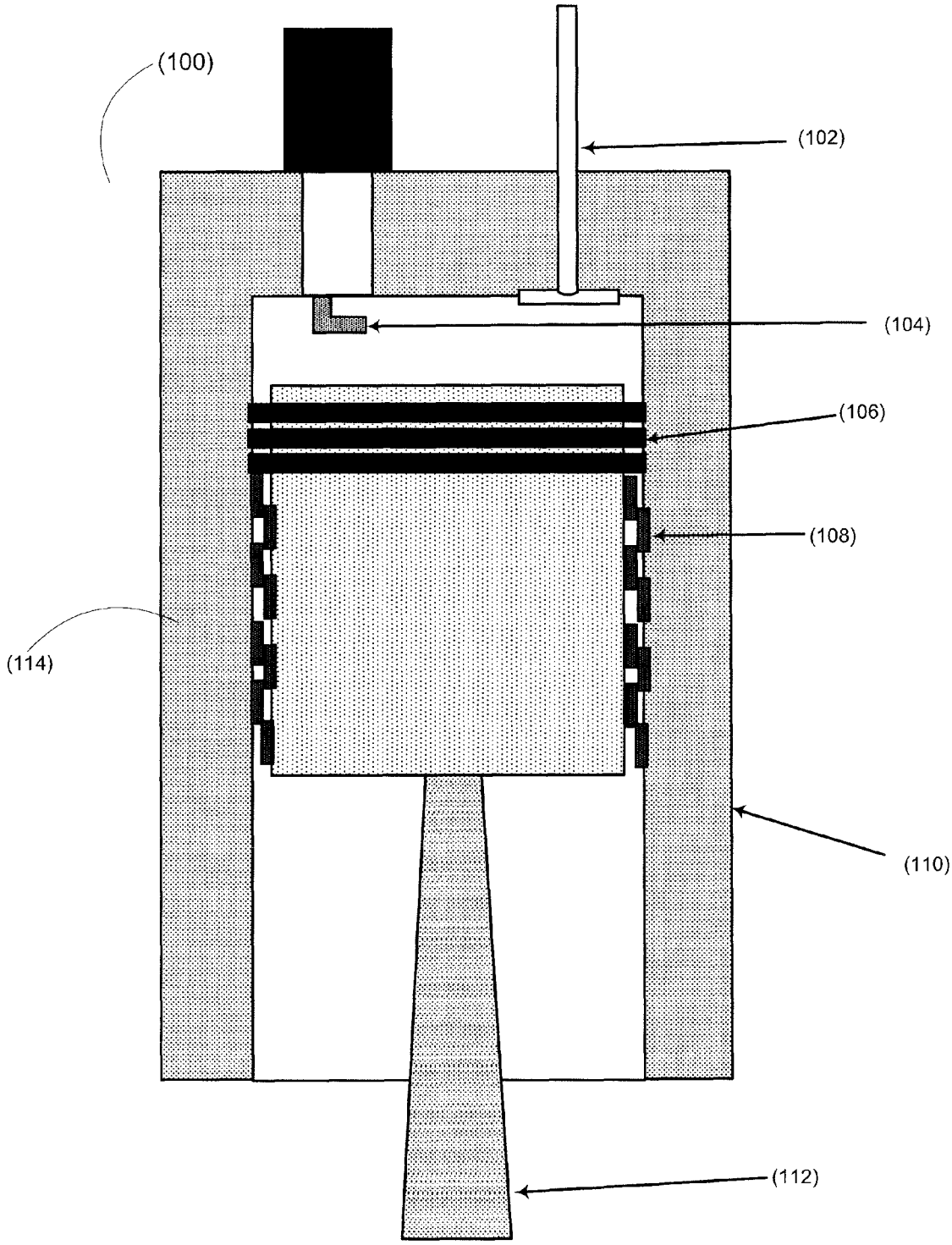
FIG. 1 shows an internal combustion engine with conformal PDC material for reducing engine friction and wear.

The present disclosure involves polymer-derived nanocomposites, lubricants using the same, and methods of preparing the same. These materials have special application in polymer-derived nanocomposites, lubricants, and methods with emphasis in conjunction with internal combustion engines, among other machines, as described below by way of non-limiting examples.

Polymer derived ceramics (PDC) are a class of ceramics derived from pyrolysis of polymers, as discussed in a paper published by Cross et al. in J. Amer. Ceram. Soc., Vol. 89, 3706-3714, 2006. As used herein, "polymer-derived nanocomposite" refers to (PDC) material that contains one or more nanoscale molecular domains.

In particular, polymer-derived nanocomposite lubricants advantageously extend the lifetime of an engine by lubricating surfaces of the engine. By way of example, polymer-derived nanocomposite lubricants may reduce the friction between a piston and cylinder or lubricate engine components, such as valve stems and cam shafts. The polymer-derived nanocomposite lubricants operate as lubricating material at high temperatures encountered within an engine.

In an embodiment, a silicon-based polymer or a silicon polymer-based nanocomposite precursor material, in liquid form, is admixed with engine oil that is placed into an internal combustion engine, such as a four cycle engine. In an embodiment, the silicon-based polymer is a material selected from the group consisting of organopolysilazane, polysilazane, polycarbosilane, polysilane, polysiloxane, and combinations thereof. The liquid silicon-based polymer reacts under high temperatures to generate a crosslinked silicon-based polymer, or a crosslinked resin. In one embodiment, the liquid silicon-based polymer forms a crosslinked resin or plastic at the hot surfaces of the engine, such as piston and cylinder surfaces that generates elevated temperature from friction. In one embodiment, the crosslinked plastic is an epoxy-like plastic. Subsequent use of the engine at normal operating temperatures generates the polymer-derived nanocomposite lubricant by in situ pyrolysis of the crosslinked resin. As used herein, the term "in-situ" refers to reaction occurring within an engine. As used herein, the term "pyrolysis" refers to thermal decomposition, or thermolysis, of organic material at elevated temperatures that may be either a complete or incomplete level of pyrolysis. In a specific embodiment, pyrolysis refers to thermolysis of a crosslinked polymer that accompanies generation of polymer derived nanocomposite or PDC material, such as silicon carbonitride (SiCN).

The crosslinked resins pyrolyze due to the high temperatures present at engine surfaces encountering friction. In one embodiment, the crosslinked resin at the hot surfaces of the engine is further converted into a wear-resistant ceramic coating formed from in-situ pyrolysis of the solid crosslinked plastic, providing the improved wear performance of the engine parts. In exemplary embodiments, substantial pyrolysis of solid crosslinked resin at engine surfaces occurs in an ex-situ context at a temperature between 600° C. and 1200° C. In one embodiment, pyrolysis of crosslinked resin occurs at a temperature of about 700° C. However, without being bound by theory, when the PDC-precursor materials are mixed with engine oil and the engine is operating at high temperature with high shear, it appears that in-situ pyrolysis or thermolysis occurs at much lower temperatures encompassing the range of temperatures encountered during normal engine operations.

In an embodiment, a silicon-based polymer is first crosslinked ex-situ into a solid crosslinked resin, and then added to the engine oil in the form of a powder. As used herein, the term "ex-situ" refers to reactions occurring outside of an engine. The powder decomposes by in-situ pyrolysis into a ceramic which coats the hot surfaces of the engine, such as the piston and the cylinder, providing enhanced engine performance by reducing friction and engine wear.

In an embodiment, engine surfaces, such as the surfaces of pistons, cylinders, and other engine parts, are coated ex-situ with a thin film of liquid silicon-based polymer that is subsequently crosslinked into an solid plastic material that coats engine parts. In exemplary embodiments, the crosslinking of the liquid silicon-based polymer occurs using ultraviolet (UV) light or by addition of a catalyst. The crosslinked silicon-based polymer film on the engine surfaces pyrolyzes in-situ into a wear-resistant ceramic coating during high-temperature engine operation.

In an embodiment, the silicon-based polymer is first crosslinked ex-situ into a solid plastic, or crosslinked silicon-based polymer, and then added to the engine oil in the form of a powder. The powder decomposes by pyrolysis into a ceramic which coats the hot surfaces of the engine, such as the piston and the cylinder, providing enhanced engine performance by reducing friction and engine-wear.

The silicon-based polymer includes silicon and at least two elements selected from oxygen, nitrogen, carbon and hydrogen. In one embodiment, composition range of PDC produced by pyrolysis of crosslinked polymers includes $SiC_xN_yO_z$. The molar ratio of nitrogen to oxygen can range from zero to one. In one nonlimiting example, the silicon-based polymer unit may have a general formula of $SiC_xN_yO_zH_m$, where x=0.7-2, y=0-0.8, z=0-0.85, and m=0-5. In one embodiment, the molar ratio of nitrogen to oxygen may range from zero to one or, conversely, the molar ratio of oxygen to nitrogen may range from zero to one. The compound may contain at least one element, oxygen, nitrogen, or combinations thereof in varying ratios. In one embodiment, a PDC material may include boron, aluminum, and combinations thereof. In exemplary embodiments, silicon-based polymers may include organopolysilazane, polysilazane, polycarbosilanes, polysilanes, and polysiloxanes.

Silicon-based polymers of the present disclosure may be present as a liquid polymer or as a solid polymer. Silicon-based polymers of the present disclosure are frequently immiscible with mineral oil derived lubricants, such as engine oil. In one embodiment, organopolysilazane is immiscible with engine oil at 2% by weight. In one embodiment, in engine oil, silicon-based polymers, such as polysilazane, may comprise from about 0.05% to about 5% by weight.

Pyrolysis, occurring within an engine, facilitates transformation of crosslinked materials, such as crosslinked resins and crosslinked silicon-based polymers, to PDCs, such as polymer-derived nanocomposite material. Advantageously, polymer-derived nanocomposites exhibit crystallization resistance and thermal stability. In various embodiments, pyrolysis of a cross-linked resin, occurring within an engine, produces silicon-oxycarbide (SiCO), silicon carbonitride (SiCN), or SiCNO. In a preferred embodiment, pyrolysis of crosslinked polysilazane, occurring within an engine, produces SiCN as a polymer-derived nanocomposite. SiCN ceramic material provides advantages for an engine additive including resistance to high temperatures, oxidation, and chemical degradation. The present polymer-derived nanocomposites lubricants exhibit numerous technical merits. For example, the polymer-derived nanocomposite lubricants, when mixed with engine oil, exhibits effectiveness at high temperatures, such as 160° C.

In one embodiment, pyrolysis of crosslinked silicon-based polymers within an engine generates polymer-derived nanocomposite material with structure containing one or more layers. Pyrolysis of crosslinked silicon-based polymers within an engine generates polymer-derived nanocomposite material with multiple layers containing geometry conforming to the engine surface. The multi-layered structure provides improved tribological properties including low friction and reduced wear of engine components. In various embodiments, the layers thicknesses are between 0.1 μm and 10 μm.

In another embodiment, pyrolysis of crosslinked silicon-based polymers within an engine generates polymer-derived nanocomposite material present as nanoparticles. The polymer-derived nanoparticle bear the frictional load of engine surfaces, thereby facilitating low engine wear.

The following examples set forth polymer-derived nanocomposites lubricants for improvement of engine wear. It is to be understood that these examples are provided by way of illustration and should not be unduly construed to limit the scope of what is disclosed herein.

EXAMPLE 1

Effect of Polymer-Derived Ceramic (PDC) for Engine Oil Under Various Temperatures The following nonlimiting example teaches by way of illustration, not by limitation, the use of crosslinked silicon-based polymers, that generate PDCs, as additives for engine oil. In particular, the PDC material was evaluated as a four stroke engine oil additive. FIG. 1 is a midsectional view of an internal combustion engine 100 with conformal PDC material 108 for reducing engine friction and wear. Internal combustion engine 100 contains valve 102, spark plug 104, piston rings 106, conformal PDC deposits 108, cylinder 110, crank shaft 112, and piston 114, all operably connected to other parts (not shown) of a working internal combustion; engine.

Figure 2:
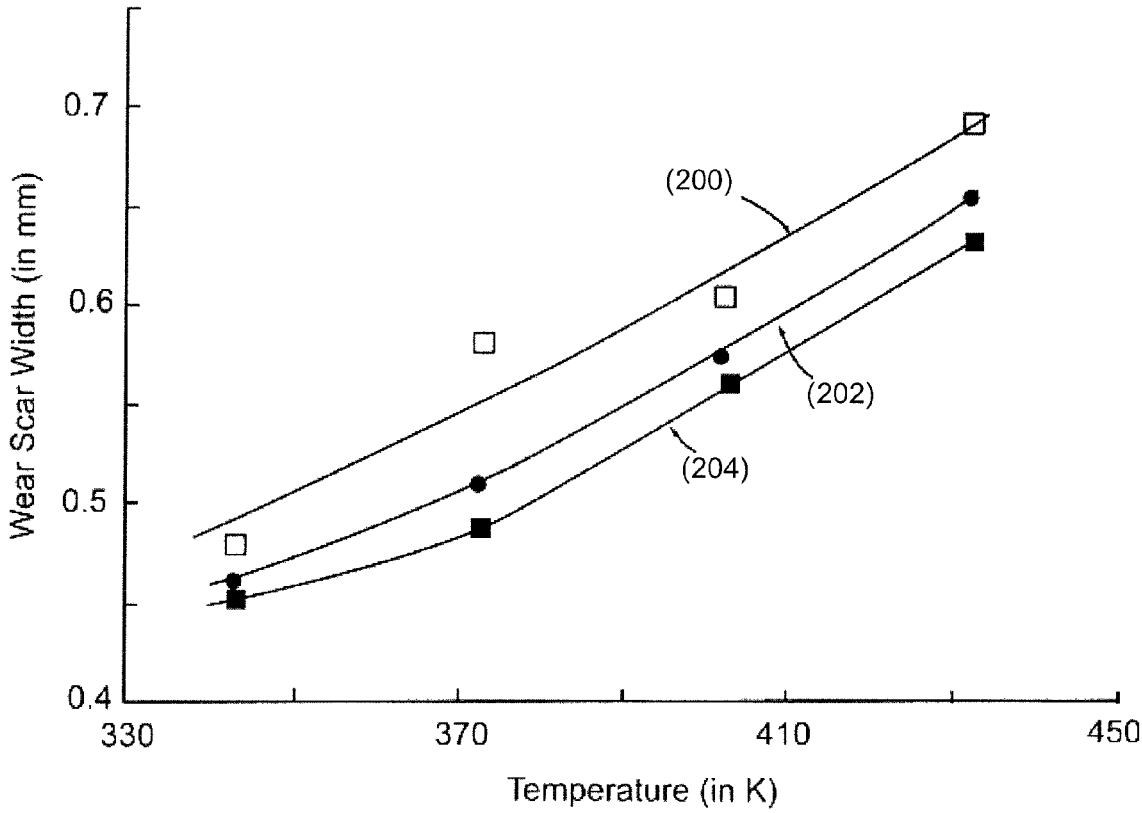
FIG. 2 shows antiwear performance of engine oil, with and without additive at different temperatures at 400 N load.

FIG. 2 displays the results of a four-ball friction test for engine oil with crosslinked silicon-based polymer additive and without crosslinked silicon-based polymer additive. In FIG. 2, the crosslinked silicon-polymer was added to engine oil in the form of a powder. The crosslinked silicon-based polymer additives of FIG. 2 were pyrolyzed in-situ during the four-ball friction test to form PDCs. The graph in FIG. 2 shows the variation in wear scar diameter at different temperatures under a load of 400 N. Curve 200 shows wear scar width at different temperatures for engine oil without crosslinked silicon-based polymer (PDC) additive. Curve 202 shows wear scar width at different temperatures for engine oil with 1 wt % crosslinked silicon-based polymer additive. Curve 204 shows wear scar width at different temperatures for engine oil with 2 wt % crosslinked silicon-based polymer additive. The graph in FIG. 2 demonstrates a reduced wear scar diameter when the engine oil has 2 wt % crosslinked silicon-based polymer additive as compared to engine oil without crosslinked silicon-based polymer additive.

Figure 3:
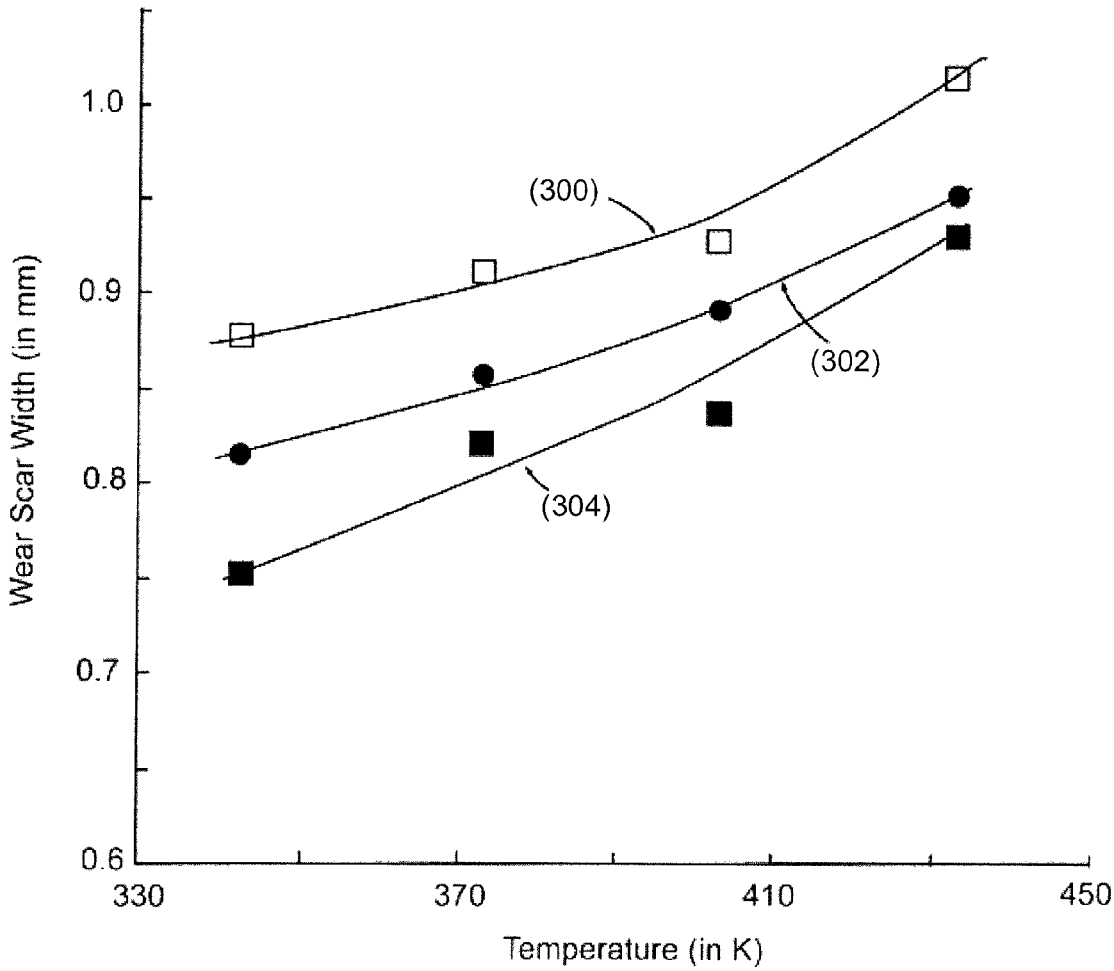
FIG. 3 shows antiwear performance of engine oil, with and without additive at different temperatures at 800 N load.

FIG. 3 displays the results of a four-ball friction test for engine oil with crosslinked silicon-based polymer additive and without crosslinked silicon-based polymer additive. The additives of FIG. 3 were pyrolyzed in-situ to form PDCs. In FIG. 3, the crosslinked silicon-based polymer was added to engine oil in the form of a powder. The graph in FIG. 3 shows the variation in wear scar diameter at different temperatures under a load of 800 N. Curve 300 shows wear scar width at different temperatures for engine oil without crosslinked silicon-based polymer additive. Curve 302 shows wear scar width at different temperatures for engine oil with 0.5 wt % of crosslinked silicon-based polymer additive. Curve 304 shows wear scar width at different temperatures for engine oil with 2 wt % crosslinked silicon-based polymer additive. The graph in FIG. 2 demonstrates a reduced wear scar diameter when the engine oil has 2 wt % crosslinked silicon-based polymer additive as compared to engine oil without additive.

EXAMPLE 2

Figure 4:
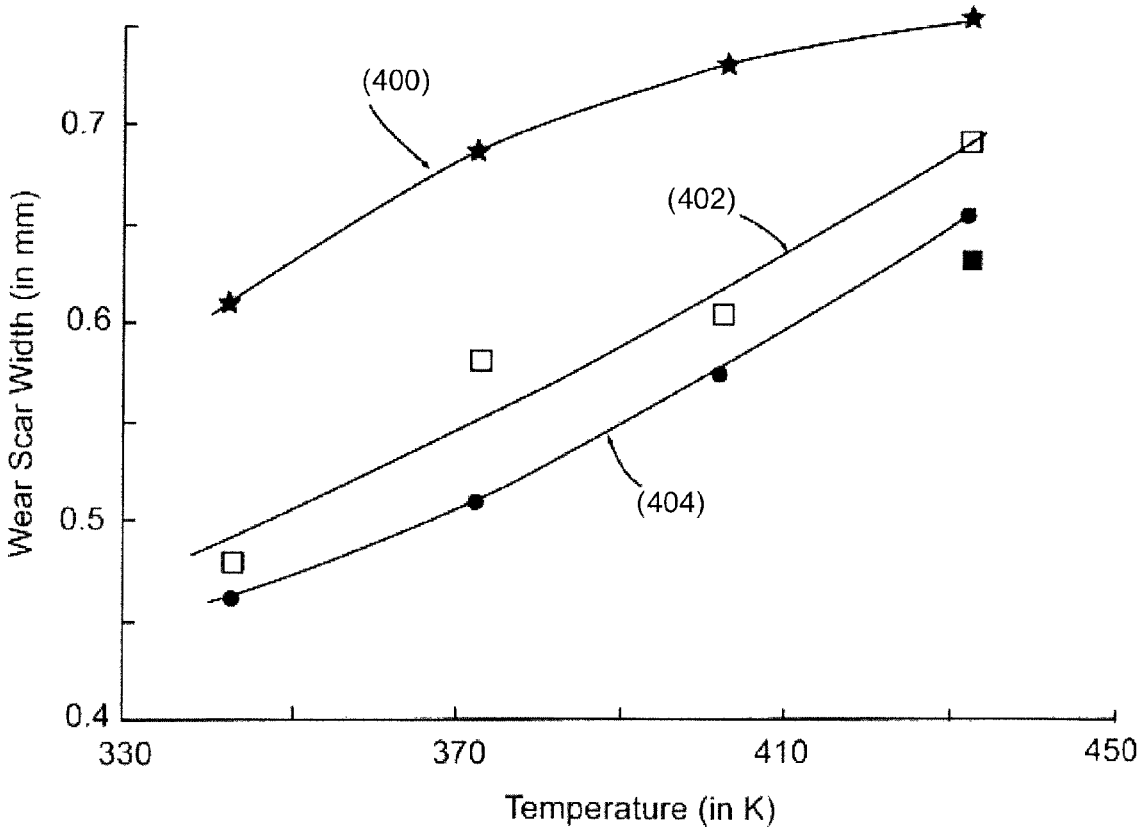
FIG. 4 shows the effects of ex-situ pyrolyzed Si-based polymer additive and in-situ pyrolyzed Si-based polymer additive at 400 N load.

Effect of In-Situ Pyrolysis and Ex-Situ Pyrolysis on Antiwear Performance of Engine Oil The following nonlimiting example teaches by way of illustration, not by limitation, the use of silicon-based polymer additives for engine oil. A four-ball friction test was utilized to monitor the effects of Si-based polymer additives on engine oil. FIG. 4 shows variation of wear scar diameter with temperature for engine oil under a load of 400 N and containing 1 wt % of crosslinked silicon-based polymer additive, and engine oil without additive. Curve 400 shows wear scar width at different temperatures for engine oil with crosslinked silicon-based polymer additive that was pyrolyzed ex-situ. Curve 402 shows wear scar width at different temperatures for engine oil without crosslinked silicon-based polymer additive. Curve 404 shows wear scar width at different temperatures for engine oil with crosslinked silicon-based polymer additive that was pyrolyzed in-situ.

Those skilled in the art will appreciate that insubstantial changes may be made to the foregoing disclosure without departing from the scope and spirit of the invention. Accordingly, the Applicant hereby states an intention to rely upon the Doctrine of Equivalents in protecting the invention as set forth in the following claims.

What is claimed is:

1. A method for improving engine wear, comprising:

providing a mixture of silicon-based polymer and motor oil;

wherein said silicon-based polymer is selected from the group consisting of organopolysilazanes, polysilazane and combinations thereof wherein the mixture of silicon-based polymer and motor oil is from about 0.05% to about 5% of silicon-based polymer by weight of the mixture;

adding the mixture to an oil reservoir of an engine and allowing the mixture to coat engine surfaces; and operating the engine to heat the motor oil to a temperature sufficient to improve lubricity of motor oil and enhance wear-resistance properties thereof wherein the silicon-based polymer when subjected to pyrolysis at normal engine operating temperatures is convertible into a polymer-derived ceramic material.

2. The method of claim 1, wherein the silicon-based polymer is a liquid.

3. The method of claim 1, wherein the silicon-based polymer is crosslinked ex-situ to form a powder.

4. A method for improving engine wear, comprising:

coating engine parts with a silicon-based polymer and motor oil;

wherein said silicon-based polymer is selected from the group consisting of organopolysilazanes, polysilazane and combinations thereof wherein the mixture of silicon-based polymer and motor oil is from about 0.05% to about 5% of silicon-based polymer by weight of the mixture;

crosslinking the silicon-based polymer coating ex-situ that is present on engine parts; and operating an engine comprised of said coated engine parts to heat the motor oil to a temperature sufficient to improve lubricity of motor oil and enhance wear-resistance properties thereof wherein the silicon-based polymer when subjected to pyrolysis at normal engine operating temperatures is convertible into a polymer-derived ceramic material.

5. The method of claim 4, wherein the crosslinking of the silicon-based polymer coating occurs by exposure to ultraviolet radiation.

6. The method of claim 4, wherein the crosslinking of the silicon-based polymer coating occurs by addition of a catalyst.

7. The method of claim 3, wherein the powder comprises particle sizes of from about 1 μm to about 50 μm.

8. The method of claim 1, wherein the engine comprises engine surfaces and wherein the engine is operated to heat the motor oil to a temperature of greater than about 600 degrees Celsius at said engine surfaces.

9. The method of claim 8, wherein pyrolysis of the silicon-based polymer occurs at said engine surfaces.

10. The method of claim 1, wherein the mixture of silicon-based polymer and motor oil is from about 0.05% to about 5% of silicon-based polymer by weight of the mixture, and wherein the engine comprises engine surfaces, and wherein the engine is operated to heat the motor oil to a temperature of greater than about 600 degrees Celsius at said engine surfaces.

11. The method of claim 10, wherein pyrolysis of the silicon-based polymer occurs at said engine surfaces.

12. The method of claim 4, wherein the engine comprises engine surfaces and wherein the engine is operated to heat the motor oil to a temperature of greater than about 600 degrees Celsius at said engine surfaces.

13. The method of claim 8, wherein pyrolysis of the silicon-based polymer occurs at said engine surfaces.

14. The motor oil of claim 1, wherein the normal operating temperatures are from about 50 degrees Celsius to about 200 degrees Celsius.

* * * * *